United States Patent [19]

Satake et al.

[11] Patent Number: 4,853,362

[45] Date of Patent: Aug. 1, 1989

[54] HEAT-SENSITIVE RECORDING SHEET

[75] Inventors: Toshimi Satake; Tadakazu Fukuchi; Toshiaki Minami; Tomoaki Nagai; Toshio Kaneko; Fumio Fujimura, all of Tokyo, Japan

[73] Assignee: Jujo Paper Co., Ltd., Tokyo, Japan

[21] Appl. No.: 234,463

[22] Filed: Aug. 19, 1988

[30] Foreign Application Priority Data

Sep. 14, 1987 [JP] Japan ..... 62-230774
Dec. 28, 1987 [JP] Japan ..... 62-333939

[51] Int. Cl.[4] ..... B41M 5/18

[52] U.S. Cl. ..... 503/209; 427/151; 428/913; 428/914; 503/217; 503/220; 503/221; 503/223

[58] Field of Search ..... 427/151, 150, 152; 428/913, 914; 503/208, 209, 216, 217, 221, 225, 220, 223

[56] References Cited

U.S. PATENT DOCUMENTS 4,761,396 8/1988 Kanda et al. ..... 503/209

FOREIGN PATENT DOCUMENTS 2074687 4/1987 Japan ..... 503/221

*Primary Examiner*—Bruce H. Hess
*Attorney, Agent, or Firm*—Koda and Androlia

[57] ABSTRACT

A heat-sensitive recording material has a support and a color-developing layer which comprises both as a colorless basic chromogenic dye at least one of a particular fluorane-type leuco dye and a particular divinyl compound and as a stabilizer a particular halogen-substituted zinc benzoate derivative.

This heat-sensitive recording material is superior in light resistance, weather resistance, oil resistance and optical readability in the near infrared region.

9 Claims, No Drawings

HEAT-SENSITIVE RECORDING SHEET

BACKGROUND OF THE INVENTION

1. Field of the Invention

This invention relates to a heat-sensitive recording material which is superior in light resistance, weather resistance, oil resistance, and optical readability in the near infrared region.

2. Prior Art

In general, a heat-sensitive recording sheet is produced by applying on a support, such as paper, synthetic paper, film, plastic et., a coating which is prepared by individually grinding and dispersing a colorless chromogenic dyestuff and an organic color-developing agent, such as phenolic material, etc., into fine particles, mixing the resultant dispersion with each other and then adding thereto binder, filler, sensitizer, slipping agent and other auxiliaries. The coating, when heated by thermal pen, thermal head, hot stamp, laser beam, etc., undergoes instantaneously a chemical reaction which forms a color. These heat-sensitive recording sheets have now been finding a wide range of applications, including industrial measurement recording instruments, terminal printers of computer, facsimile equipments, automatic ticket vending machines, printer for bar-code-label, and so on. In recent years, as the application of such recording equipment is enhanced, high qualities are required for heat-sensitive recording sheets. For example, even with small heat energy in a high speed recoding, both the clear image with a high density and the better preservability such as better resistance to light, weather and oil, etc. are required. These heat-sensitive recording sheets are also utilized as thermosensitive labels. Since, however, color formation in these recording sheets is in the visible region, they cannot be adapted for reading by a semiconductor laser in the near infrared region which is widely used as a bar code scanner in a POS system, etc.

On the other hand, Japanese Laid-Open Patent Publication Nos. 59-199757 and 60-226871 disclose a heat-sensitive recording sheet containing a combination of a conventional color developing agent (phenol resin, hydroxybenzoate and bisphenol-A) and a fluorane-type leuco dyestuff having excellent color-developing ability in the near infrared region. Japanese Laid-Open Patent Publication Nos. 62-243652, 62-243653 and 62-257970 disclose a heat-sensitive recording sheet containing a combination of a conventional color developing agent and a divinyl compound having excellent color-developing ability in the near infrared region.

However, these heat-sensitive recording sheets have a remarkably inferior stability (inferior resistance to light, weather and oils) of the recorded image. Hence, in long storage under condition of exposure to light, moisture, etc., the recorded image is discolored, the image density is reduced, and sometimes the image disappears, which deteriorates a optical readability in near infrared region. By the adhesion of serum, or by contact with plasticizer (DOP, DOA etc.) in wraping film, such as vinyl chloride film, the image density is prominently lowered or the recorded image disappears, which causes a remarkable reduction of a optical readability in the near infrared region. In view of above defects, the practical use of these heat-sensitive recording sheets was difficult.

SUMMARY OF THE INVENTION

It is the object of this invention to provide a heat-sensitive recording material which is superior in optical readability in the near infrared region.

It is the another object of this invention to provide a heat-sensitive recording material which is better in light resistance, weather resistance and oil resistance.

It is the further object of this invention to provide a heat-sensitive recording material which is usable under severe conditions in bar-code-label, etc.

The above-mentioned objects can be performed as follows. The heat-sensitive recording material comprises a support having thereon a color-developing layer which comprises as a colorless or pale colored basic chromogenic dye at least one substance selected from the group consisting of a fluorane-type leuco dye represented by the following general formula (I) and a divinyl compound represented by the following general formula (II), and as a stabilizer at least one halogen-substituted zinc benzoate derivatives represented by the following general formula (III):

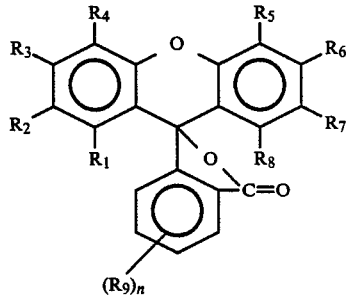

(I)

wherein at least one of $R_1$, $R_2$, $R_3$, $R_4$, $R_5$, $R_6$, $R_7$, $R_8$ and $R_9$ represents

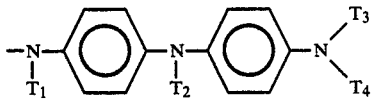

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group, or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with a nitrogen to which they are attached, may represent, a morpholino group, a pyrrolidino group, a piperidino group or a hexamethyleneimino group; and n represent an integer from 0 to 4;

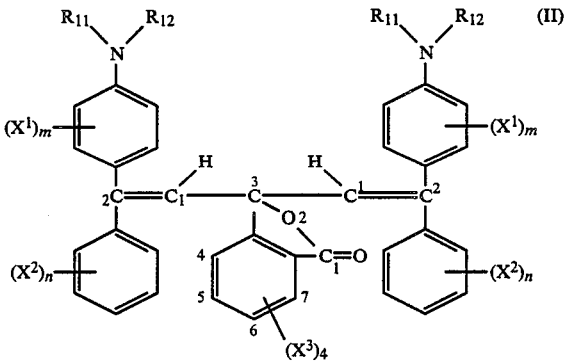

(II)

wherein $R_{11}$ represents an alkyl group of not more than 8 carbon atoms;

$R_{12}$ represents an alkyl group of not more than 8 carbon atoms, a $C_5$–$C_7$ cycloalkyl group, a benzyl group which may be substituted with a chlorine atom, a bromine atom and/or an alkyl group of not more than 4 carbon atoms, or a phenyl group which may be substituted with a chlorine atom, a bromine atom and/or an alkyl group of not more than 4 carbon atoms;

$X_1$ and $X_2$, which may be the same or different, represent an alkyl group of not more than 8 carbon atoms, an alkoxy group of not more than 8 carbon atoms, a fluorine atoms, a chlorine atom or a bromine atom; m and n each represents 0, 1, 2 or 3;

each $X^1$ of $(X^1)_n$, each $X^2$ of $(X^2)_n$ or each $X^3$ of $(X^3)_n$ can be the same or different; and $X^3$ represents a chlorine atom or a bromine atom, in which at least one of $X^3$ in $(X^3)_4$ represents a bromine atom;

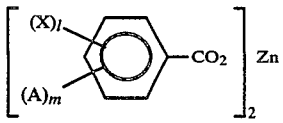

(III)

wherein

X represents a halogen atom;

A represents a halogen atom, a nitro group, a $C_1$–$C_{12}$ alkyl group, a $C_1$–$C_{12}$ alkoxy group, a $C_3$–$C_{10}$ cycloalkyl group, a cyano group or a hydroxy group; l represents 1 or 2; and m represents an integer from 0 to 5.

Among the fluorantype leuco dyes of the general formula (I), the dyes of the following general formula (IV) is preferable.

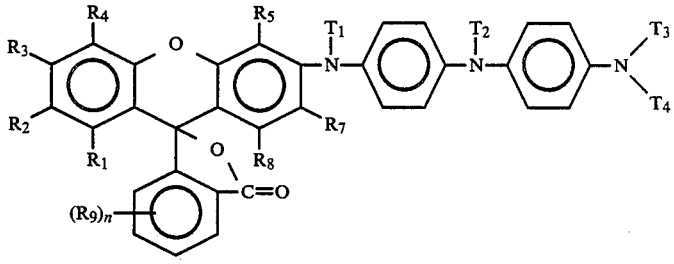

(IV)

wherein $R_1$, $R_2$, $R_3$, $R_4$, $R_5$, $R_7$, $R_8$, $T_1$, $T_2$, $T_3$, $T_4$ and n are as defined above.

Taking the productivity, costs and performances into consideration, 2-methyl-6-p-(p-dimethylaminophenyl-)aminoanilinofluoran (m.p 197°–230° C.) of the following formula (V) and 2-chloro-3-methyl-6-p-(p-phenylaminophenyl)aminoanilinofluoran (m.p: 191.5°–196° C.) of the following formula (VI) are most preferable.

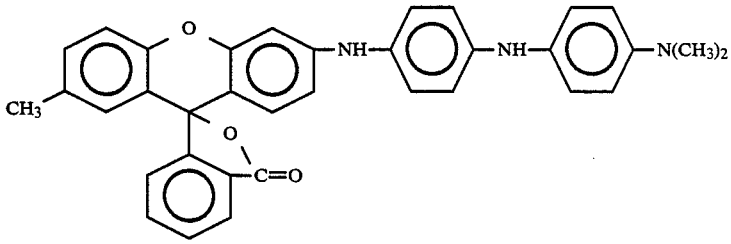

(V)

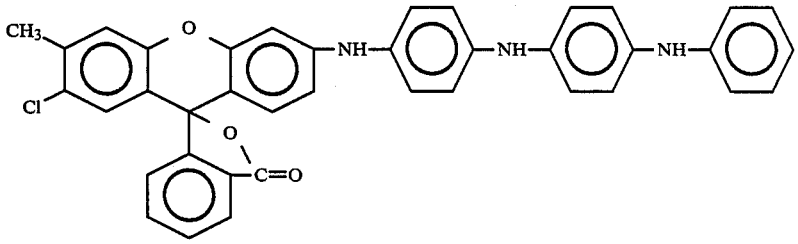

(VI)

The fluoran type leuco dyes of this invention are not particularly limited and include, for example, 2-methyl- 6-p-(p-dimethylaminophenyl)aminoanilinofluoran, 2-methoxy-6-p-(p-dimethylaminophenyl)aminoanilinofluoran, 2-chloro-6-p-(p-dimethylaminophenyl-)aminoanilinofluoran, p-nitro-6-p-(p-diethylaminophenyl)aminoanilinofluoran, 2-amino-6-p-(p-diethylaminophenyl)aminoanilinofluoran, 2-diethylamino-6-p-(p-diethylaminophenyl)aminoanilinofluoran, 2-phenyl-6-(p-phenylaminophenyl)aminoanilinofluoran, 2-benzyl-6-p-(p-penylaminophenyl)aminoanilinofluoran, 2-hydroxy-6-p-(p-phenylaminophenyl) aminoanilinofluoran, 3-methyl-6-p-(p-dimethylaminophenyl-)aminoanilinofluoran, 3-diethylamino-6-p-(p-diethylaminophenyl)aminoanilinofluoran, 3-diethylamino-6-p-(p-dibuthylaminophenyl)aminoanilinofluoran, 3-methyl-7-p-()p-dimethylaminophenyl)aminoanilinofluoran, 3-methoxy-7-p-(p-dimethylaminophenyl-)aminoanilinofluoran, 3-chloro-7-p-(p-dimethylaminophenyl) aminoanilinofluoran, 3-nitro-7-p-(p-diethylaminophenyl) aminoanilinofluoran, 3-amino-7-p-(p-diethylaminophenyl) aminoanilinofluoran, 3-diethylamino-7-p-(p-diethylaminophenyl)aminoanilinofluoran, 3-phenyl-7-p(p-phenylaminophenyl-)aminoanilinofluoran, 3-benzyl-7-p-(p-phenylaminophenyl)aminoanilinofluoran, 3-hydroxy-7-p-(p-phenylaminophenyl)aminoanilinofluoran, 2-methyl-7-p-(p-dimethylaminophenyl)aminoanilinofluoran, 2-diethylamino7-p-(p-diethylamino)-7-p(p-diethylaminophenyl)aminoanilinofluoran, 2-diethylamino-7-p-(p-dibutylaminophenyl)aminoanilinofluoran, 2-p-(p-dimethylaminophenyl) aminoanilino-6-methylfluoran, 2-p-(p-dimethylaminophenyl)aminoanilino-6-methoxyfluoran, 2-p-(p-dimethylaminophenyl)aminoanilino-6-chlorofluoran, 2-p-(p-diethylaminophenyl-)aminoanilino-6-nitrofluoran, 2-p-(p-diethylaminophenyl)aminoanilino-6-aminofluoran, 2-p-(p-diethylaminophenyl)aminoanilino-6-diethylaminofluoran, 2-p-(p-phenylaminophenyl)aminoanilino-6-phenylfluoran, 2-p-(p-phenylaminophenyl)aminoanilino-6-benzylfluoran, 2-p-(p-phenylaminophenyl)aminoanilino-6-hydroxyfluoran, 2-p-(p-dimethylaminophenyl-)aminoanilino-6-methylfluoran, 2-p-(p-diethylaminophenyl)aminoanilino-6-diethylaminofluoran, 2-p-(p-phenylaminophenyl)aminoanilino-6-diethylaminofluoran, 3-p-(p-dimethylaminophenyl)aminoanilino-7-methylfluoran, 3-p-(p-dimethylaminophenyl-)aminoanilino-7-methoxyfluoran, 3-p-(p-dimethylaminophenyl)aminoanilino-7-chlorofluoran, 3-p-(p-diethylaminophenyl)aminoanilino-7-nitrofluoran, 3-p-(p-diethylaminophenyl)aminoanilino-7-aminofluoran, 3-p-(p-diethylaminophenyl)aminoanilino-7-diethylaminofluoran, 3-p-(p-phenylaminophenyl-)aminoanilino-7-phenylfluoran, 3-p-(p-phenylaminophenyl)aminoanilino-7-benzylfluoran, 3-p-(p-phenylaminophenyl)aminoanilino-7-hydroxyfluoran, 3-p-(p-dimethylaminophenyl)aminoanilino-7-methylfluoran, 3-p-(p-diethylaminophenyl)aminoanilino-7-diethylaminofluoran, and 3-p-(p-phenylaminophenyl-)aminoanilino-7-diethylaminofluoran.

The divinyl compounds of the general formula (II) are not particularly limited and include, for example, the following compounds:

| Na | $R_1$ | $R_2$ | $(X^1)_m$ | $(X^2)_m$ | $(X^3)_4$ |
|---|---|---|---|---|---|
| 1 | $CH_3$ | $CH_3$ | H | p-$OCH_3$ | $(Br)_4$ |
| 2 | " | " | " | " | 5-Cl $(Br)_3$ |
| 3 | " | " | " | p-$OC_4H_9$ | 5,6-$(Cl)_2$ $(Br)_2$ |
| 4 | " | " | " | p-$OC_6H_{13}$ | $(Br)_4$ |
| 5 | " | " | " | H | " |
| 6 | " | " | " | p-$CH_3$ | " |
| 7 | " | " | " | " | 5-Cl $(Br)_3$ |
| 8 | " | " | " | p-tert-$C_4H_9$ | $(Br)_4$ |
| 9 | " | " | " | m,p-$(OCH_3)_2$ | " |
| 10 | $C_2H_5$ | $C_2H_5$ | " | p-$OCH_3$ | " |
| 11 | " | " | " | p-$CH_3$ | " |
| 12 | " | " | m-$CH_3$ | p-$OCH_3$ | " |
| 13 | $C_4H_9$ | $C_4H_9$ | H | p-$OC_2H_5$ | " |
| 14 | $C_2H_5$ | iso-$C_5H_{11}$ | " | p-tert-$C_4H_9$ | " |
| 15 | $C_2H_5$ | 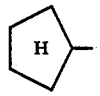 | " | p-$OCH_3$ | " |
| 16 | $CH_3$ | 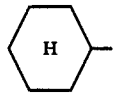 | " | " | " |
| 17 | $C_2H_5$ | 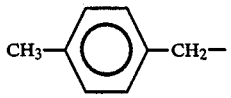 | m-$OCH_3$ | m,p-$(CH_3)_2$ | 5-Cl $(Br)_3$ |

Among the divinyl compound of the general formula (II), 3, 3-bis[2-(p-dimethylaminophenyl)-2-(p-methoxyphenyl) ethenyl]- 4, 5, 6, 7 - tetrabromophthalide (m.p.: 133°–135° C.) is most preferable, taking the productivity, costs and performances into consideration.

In the general formula (III), the "$C_1$–$C_{12}$ alkyl group" and "$C_1$–$C_{12}$ alkoxy group" may be linear or branched, and include, for example, methyl, ethyl, npropyl, isopropyl, n-butyl, iso-butyl, sec-butyl, hexyl, octyl, nonyl, dodecyl, methoxy, ethoxy, tert-butoxy, and the like. The $C_3$–$C_{10}$ cycloalkyl group includes, for example, cyclohexyl, 2-ethylcyclohexyl, p-tertbutylcyclohexyl, and the like.

The halogen-substituted zinc benzoate derivatives of this invention are colorless materials having a highmelting point, which can be produced by reaction of the halogen-substituted benzoic acid sodium salts with zinc sulfate.

The above stabilizer of this invention is a compound having a particular molecular-structure selected from many organic carboxylic acid metal salts. The benzoic acid zinc salts having 1–2 halogen substituents on the benzene ring have excellent light-, weight- and oil-resistances, which are not seen in similar free organc carboxylic acids or their polyvalent-metal salts.

Typical examples of the zinc benzoate derivatives used in this invention are shown below. It should be understood, however, that they are merely illustrative, and the scope of this invention is not limited thereby.

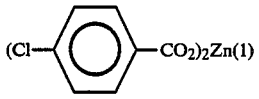

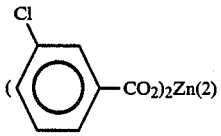

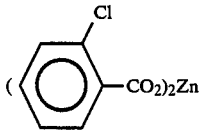

(3)

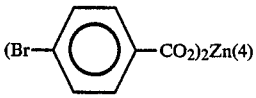

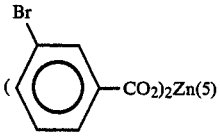

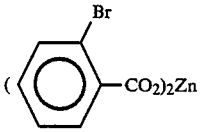

(6)

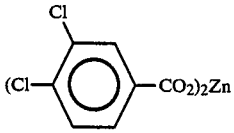

(7)

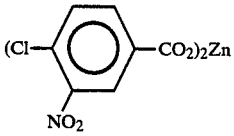

(8)

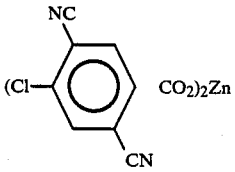

(9)

-continued

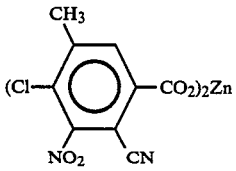

(10)

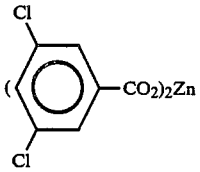

(11)

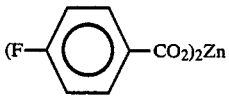

(12)

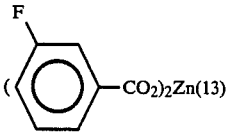

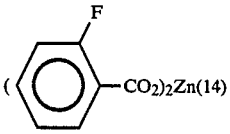

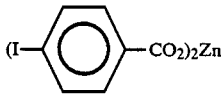

(15)

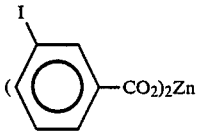

(16)

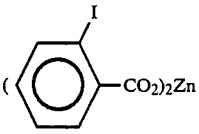

(17))

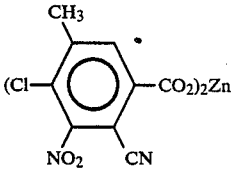

(18)

The preferable organic color-developing agent of this invention are: bisphenols-A, 4-hydroxybenzoic acid esters, 4-hydroxyphthalic acid diesters, phthalic acid monoesters, bis-(hydroxyphenyl) sulfides, 4-hydroxyphenyl arylsulfonate, 4-hydroxyphenyl arylsulfonates, 1,3-di[2-(hydroxyphenyl)-2-propyl]benzenes, 4-hydroxybenzoyl oxybenzoic acid esters, bisphenol sulfonates and the like. Examples of these color-developing agents are as follows:

Bisphenols A 4,4'-isopropylidenediphenols(bisphenol A)

4,4'-cyclohexylidenediphenol
p,p'-(1-methyl-normalhexylidene)diphenol 1,7-di(4-hydroxyphenylthio)-3,5-dioxaheptane
4-hydroxybenzoic acid esters
4-hydroxybenzoic acid benzyl ester
4-hydroxybenzoic acid ethyl ester
4-hydroxybenzoic acid propyl ester
4-hydroxybenzoic acid isopropyl ester
4-hydroxybenzoic acid butyl ester
4-hydroxybenzoic acid isobutyl ester
4-hydroxybenzoic acid methylbenzyl ester
4-hydroxyphthalic acid diesters
4-hydroxyphthalic acid dimethylester
4-hydroxyphthalic acid diisopropyl ester
4-hydroxyphthalic acid dibenzyl ester
4-hydroxyphthalic acid dihexyl ester
Phthalic acid monoesters
Phthalic acid monobenzyl ester
Phthalic acid monocyclohexyl ester
Phthalic acid monophenyl ester
Phthalic acid monomethylphenyl ester
Phthalic acid monoethylphenyl ester
Phthalic acid monoalkylbenzyl ester
Phthalic acid monohalogenebenzyl ester
Phthalic acid monoalkoxybenzyl ester
Bis-(hydroxyphenyl)sulfides
Bis-(4-hydroxy-3-tert-butyl-6-methylphenyl)sulfide
Bis-(4-hydroxy-2,5-dimethylpheyl)sulfide
Bis-(4-hydroxy-2-methyl-5-ethylphenyl)sulfide
Bis-(4-hydroxy-2-methyl-5-isopropylphenyl)sulfide
Bis-(4-hydroxy-2,3-dimethylphenyl)sulfide
Bis-(4-hydroxy-2,5-diethylphenyl)sulfide
Bis-(4-hydroxy-2,5-diisopropylphenyl)sulfide
Bis-(4-hydroxy-2,3,6-trimethjylphenyl)sulfide
Bis-(2,4,5-trihydroxyphenyl)sulfide
Bis-(4-hydroxy-2-cyclohexyl-5-methylphenyl)sulfide
Bis-(2,3,4-trihydroxyphenyl)sulfide
Bis-(4,5-dihydroxy-2-tert-butylphenyl)sulfide
Bis-(4-hydroxy-2,5-diphenylphenyl)sulfide
Bis-(4-hydroxy-2-tert-octyl-5-methylphenyl)sulfide
4-hydroxyphenylarylsulfones
4-hydroxy-4'-isopropoxydiphenyl sulfone
4-hydroxy-4'-methyldiphenyl sulfone
4-hydroxy-4'-n-butyloxydiphenyl sulfone
4-hydroxy phenylarylsulfonates
4-hydroxyphenylbenzene sulfonate
4-hydroxyphenyl-p-tolyl sulfonate
4-hydroxyphenyl- methylene sulfonate
4-hydroxyphenyl-p-chlorobenzene sulfonate
4-hydroxyphenyl-p-tert-butylbenzene sulfonate
4-hydroxyphenyl-p-isopropoxybenzene sulfonate
4-hydroxyphenyl-1'-naphthaline sulfonate
4-hydroxyphenyl-2'-naphthaline sulfonate
1,3-di[2-(hydroxyphenyl)-2-propyl]-benzenes
1,3-di[2-(4-hydroxyphenyl)-2-propyl]-benzene
1,3-di[2-(4-hydroxy-3-alkylphenyl)2-propyl]-benzene
1,3-di[2-(2,4-dihydroxyphenl)-2-propyl]-benzene
1,3-di[2-hydroxy-5-methylphenyl)-2-propyl]-benzene
Resorcinoles
1,3-dihydroxy-6(α,α-dimethylbenzyl)-benzene

4-HYDROXY BENZOYLOXYBENZOIC ACID ESTERS 4-hydroxybenzoyloxybenzoic acid benzyl ester
4-hydroxybenzoyloxybenzoic acid methyl ester
4-hydroxybenzoyloxybenzoic acid ethyl ester
4-hydroxybenzoyloxybenzoic acid propyl ester
4-hydroxybenzoyloxybenzoic acid butyl ester
4-hydroxybenzoyloxybenzoic acid isopropyl ester
4-hydroxybenzoyloxybenzoic acid tert.-butyl ester
4-hydroxybenzoyloxybenzoic acid hexyl ester
4-hydroxybenzoyloxybenzoic acid octyl ester
4-hydroxybenzoyloxybenzoic acid nonyl ester
4-hydroxybenzoyloxybenzoic acid cyclohexyl ester
4-hydroxybenzoyloxybenzoic acid β-phenethyl ester
4-hydroxybenzoyloxybenzoic acid phenyl ester
4-hydroxybenzoyloxybenzoic acid α-naphthyl ester
4-hydroxybenzoyloxybenzoic acid β-naphthyl ester
4-hydroxybenzoyloxybenzoic acid sec-butyl ester

BISPHENOL-SULFONES (I)

Bis-(3-1-butyl4-hydroxy-6-methylphenyl)sulfone
Bis-(3-ethyl-4-hydroxy phenyl)sulfone
Bis-(3-propyl-4-hydroxyphenyl)sulfone
Bis-(3-methyl-4-hydroxyphenyl)sulfone
Bis(2-isopropyl-4-hydroxyphenyl)sulfone
Bis-(2ethyl-4-hydroxyphenyl)sulfone
Bis-(3-chloro-4-hydroxyphenyl)sulfone
Bis-(2,3-dimethyl-4-hydroxyphenyl)sulfone
Bis-2,5-dimethyl-4-hydroxyphenyl)sulfone
Bis-(3-methoxy-4-hydroxyphenyl)sulfone
4-hydroxyphenyl-2'-ethyl-4'-hydroxyphenylsulfone
4-hydroxyphenyl-2'-isopropyl-4'-hyroxyphenylsulfone
4-hydroxyphenyl-3'-isopropyl-4'-hydroxyphenylsulfone
4-hydroxyphenyl-3'-sec-butyl-4'-hyroxyphenylsulfone
3-chloro-4-hydroxyphenyl-3--isopropyl-4'-hydroxyphenylsulfone
4-hydroxy-5-t-butylphenyl-4'-hydroxyphenylsulfone
2-hydroxy-5-t-amynophenyl-4'-hydroxyphenylsulfone
2-hydroxy-5-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hyroxyphenylsulfone
2-hydroxy-5-t-butylphenyl-3'-isopropyl-4-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone

BISPHENOLSULFONES (II)

4,4'-sulfonyldiphenol
2,4'-sulfonyldiphenol
3,3'-dichloro-4,4'-sulfonyldiphenol
3,3'-dibromo-4,4'-sulfonyldiphenol
3,3',5,5'-tetrabromo-4,4'-sulfonyldiphenol
3,3'-diamio-4,4'-sulfonyldiphenol

OTHERS p-tert-butylphenol
2,4-hydroxybenzophenone
Novolac-phenolic resin
4-hydroxyacetophenone
p-phenylphenol
benzyl4-hydroxyphenyl acetate
p-benzylphenol The above color-developing agents may be used either alone or in combination.

In order to improve the optical readability in the near infrared region, fluorene type leuco dyes, other divinyl-type phthalide derivatives than those of the general formula (II), sulfonylmethane derivative, etc. may be used in combination with the fluorane-type leuco dye of the general formula (I), and fluorene-type leuco dyes, sulfonylmethane derivatives, fluorane-type leuco dyes other than those of the general formula (I), etc. may be used in combination with the divinyl-type phthalide derivative of the general formula (II).

The preferable fluorene-type leuco dyes of this invention are the near infrared-absorbing leuco dyes represented by the following formula (VII).

(VII)

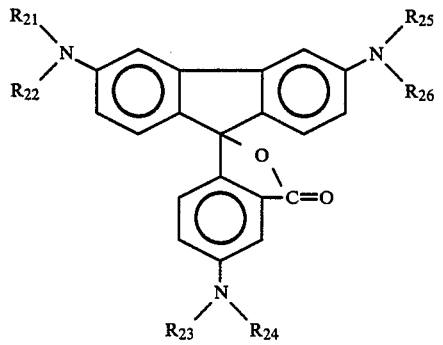

wherein $R_{21}$, $R_{22}$, $R_{23}$, $R_{24}$, $R_{25}$ and $R_{26}$, which may be the same or different, represent a hydrogen atom; a $C_1$–$C_8$ alkyl group; a $C_5$–$C_8$ cycloalkyl group; a $C_3$–$C_8$ alkoxyalkyl group; a $C_3$–$C_9$ unsaturated alkyl group, a tetrahydrofurfuryl group; a tetrahydropyran-2-methyl group; an alkyl group which may be substituted by a halogen atom, a $C_1$–$C_4$ alkyl group and/or a $C_1$–$C_4$ alkoxy group; an aryl group which may be substituted by a halogen atom, a $C_1$–$C_4$ alkyl group and/or a $C_1$–$C_4$ alkoxy group; a $C_2$–$C_8$ alkyl group having a phenoxy group which may be substituted by a halogen atom, a $C_1$–$C_4$ alkyl group and/or a $C_1$–$C_4$ alkoxy group; in addition, $R_{21}$ and $R_{22}$, $R_{23}$ and $R_{24}$, or $R_{25}$ and $R_{26}$ taken together with each other or with an attached benzene ring may form a heterocyclic ring.

The leuco dyes represented by the general formula (VII) are not limited, the typical examples are, however, 3,6-bis(dimethylamino)fluororene-9-spiro-3'-(6'-dimethylamino)phthalide and 3,6-bis(diethylamino)-fluorene-9-spiro-3'-(6'-diethylamino)phthalide.

The preferable divinylphthalide derivatives used in combination with the fluoran-type leuco dye of the general formula (I) are near infrared-absorbing leuco dyes represented by the general formula (VIII):

(VIII)

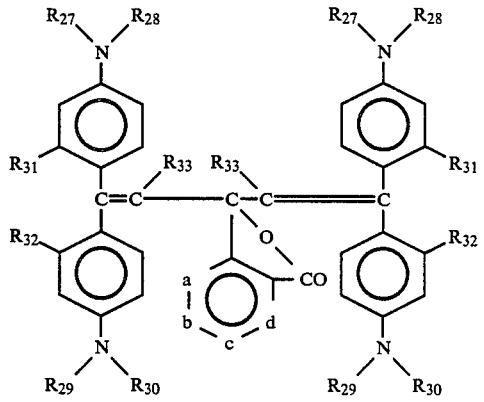

wherein $R_{27}$, $R_{28}$, $R_{29}$ and $R_{30}$, which may be the same or different, represent a $C_1$–$C_8$ alkyl group, a $C_5$–$C_8$ cycloalkyl group, a $C_3$–$C_8$ alkoxyalkyl group, an aryl group which may be substituted by a halogen atom, a $C_1$–$C_4$ alkyl group and/or a $C_1$–$C_4$ alkoxy grup, or an alkyl group which may be substituted by a halogen atom, a $C_1$–$C_4$ alkyl group and/or a $C_1$–$C_4$ alkoxy group, in addition, $R_{27}$ and $R_{28}$, or $R_{29}$ and $R_{30}$ taken together with each or with an attached benzene ring may form a heterocyclic ring;

$R_{31}$ and $R_{32}$, which may be the same or different, represent a hydrogen atom, a halogen atom, a $C_1$–$C_4$ alkyl group, a $C_1$–$C_4$ alkoxy group, or an acyloxy group;

$R_{33}$ represents a hydrogen atom, or a $C_1$–$C_4$ alkyl group;

a, b, c and d represent carbon atoms, or one or two of a, b, c and d may represent a nitrogen atom, in addition, the carbon atoms of a, b, c and d may have as substituent a hydrogen atom, a halogen atom, a $C_1$–$C_8$ alkyl group, a $C_1$–$C_4$ alkoxy group, a $C_2$–$C_{16}$ dialkylamino group or a nitro group; and the bonding of a-b, b-c or c-d may form the other aromatic ring.

The preferable sulfonylmethane derivatives are the near infrared-absorbing leuco dye of the following general formula (IX)

(IX)

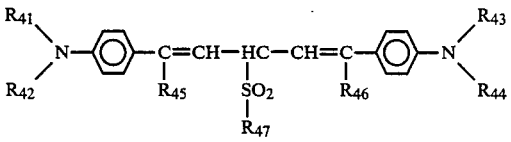

wherein $R_{41}$, $R_{42}$, $R_{43}$ and $R_{44}$ which may be the same or different, represent a hydrogen atom, or a substituted or unsubstituted alkyl group;

$R_{45}$ and $R_{46}$, which may be the same or different, represent a hydrogen atom, or a substituted or unsubstituted phenyl group; and $R_{47}$ represents a substituted or unsubstituted alkyl group, or a substituted or unsubstituted phenyl group.

The leuco dyes represented by the general formula (IX) are not limited, the typical examples are, however, bis(p-dimethylaminostyryl)-p-methylphenylsulfonylmethane, bis(p-diethylaminostyryl)-p-methylphenylmethane and bi(p-dimethylaminostyryl)benzenesulfonylmethane.

As sensitizer, there may be used fatty acid amide such as stearic acid amide, palmitic acid amide; ethylenebisamide; montan wax; polyethylene wax; dibenzyl terephthalate; benzyl p-benzyloxybenzoate; di-p-tolyl carbonate; p-benzylbiphenyl, phenyl α-naphthylcarbonate; 1,4-diethoxynaphthalene; 1-hydroxy-2-naphthoic acid phenyl ester; and the like.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in an solvent such as water, alcohol, ketone, ester hydrocarbon, etc., or after they were emulsified or dispersed in water or a solvent other than water.

The species and the amount of organic color-developing agent, colorless basic chromogenic dye and other ingredients, which are used in this invention, are determined depending upon the performance and recording aptitude required for the recording material, and are not otherwise limited. However, in ordinary cases, it is suitable to use 1–8 parts by weight of organic color developing agent, 0.1–5 parts by weight of stabilizer and 1–20 parts by weight of filler, based on 1 part by weight of colorless basic chromogenic dye, and to add 10–25 parts by weight of a binder in total solid content.

The aimed heat-sensitive recording material may be obtained by coating the above coating composition on a substrate such as paper, synthetic paper, film, etc.

The above organic color-developing agent, the above colorless basic chromogenic dye, and if necessary, other ingredients are ground to a particle size of several microns or smaller by means of a grinder or emulsifier such as a ball mill, attritor, sand grinder, etc., and binders and various additives in accordance with the purpose, are added thereto to prepare coating color. Such additives ar as follows: filler; releasing agent for prevention of sticking, such as fatty acid metal salt; anti-fogging agent such as fatty acid amide, ethylenebisamide, montan wax, polyethylene wax etc.; dispersant such as sodium dioctylsulfosuccinate, sodium dodecylbenzene sulfonate, sodium lauryl alcohol sulfate, sodium alginate; UV-absorber such as benzophenone type or triazole type; antifoamer; fluorecent brightening agent; water resistance agent; and so on.

As filler, there may be used any organic or inorganic filler usually used in the paper-manufacturing field. Examples for fillers of this invention include clay, talc, silica, magnesium carbonate, alumina, aluminum hydroxide, magnesium hydroxide, barium sulfate, kaolin, titanium dioxide, zinc oxide, calcium carbonate, aluminum oxide, urea-formalin resin, polystyrene resin, phenol resin, etc.

The reason why the heat-sensitive recording sheet of this invention provides a superior optical readability in the near infrared region is thought as follows. The color image in using electron-donating color-former such as conventional fluroane-type leuco dyes does not absorb the light of near infrared region. However, the fluorane-type leuco dyes of the general formula (I) or the divinyl compounds of the general formula (II) absorb the light of near infrared region (specifically the near infrared region of 700–1500 nm) efficiently in a heat-melt reaction with an electron acceptor (color-developing agent).

The reason why the recorded image of a heat-sensitive recording material of this invention is excellent in light-resistance, weather-resistance and oil resistance is explained as follows. Generally, a heat-sensitive recording material is composed of colorless basic dye as electron donor and of organic acidic material, such as phenolic material, aromatic carboxylic acid, organic sulfonic acid, etc. as electron acceptor. The heat-melt reaction between a colorless basic dye and a color-developing agent is an acid-base reaction based on donating-acceptance of electron, whereby a pseudo-stable "electron charge transfer complex" is produced, which forms color.

On the other hand, the chemical binding force in the above reaction between the florane-type leuco dye of this invention and the organic developing agent is very weak. In the halogen-substituted zinc benzoate derivative, the halogen atom which is bonded to a benzene-skelton, causes a decrease of an electronic density on a metal through n-electrons of a benzene ring since it has a high electron-attractive force. Further, zinc is a transient metal atom having electron-acceptive, vacant d-orbital, in contrary to the other polyvalent metals (magnesium, aluminum, calcium, titanium, manganese, tin and nickel).

Accordingly, in the heat-melt reaction, the halogen-substituted zinc benzoate derivatives produces a prominent increase of the chemical bonding force between an organic color-developing agent and each of the fluorane-type leuco dye represented by the general formula (I) and the divinyl compound represented by the general formula (II), and hence it seems that the chemical bondings do not deteriorate for a long period even under the circumstance of light, heat, humidity, etc., so that a recorded image is remarkably stable, which does not lower the optical readability of the recorded image in the near infrared region. And the reason for a superior thermal responsibility in using the divinyl compound of the general formula (II) is as follows. The halogen-substituted zinc benzoate derivative has an excellent color-developing ability, and product a synergism in combination with another organic color-developing agent, which increases a color-developing sensitivity prominently.

(EXAMPLES)

The following examples illustrate the invention, although this invention is not limited to examples. The parts are parts by weight.

[Example 1 (Test No. 1–2)]

Liquid A (dye dispersion)

-continued

| | |
|---|---|
| Colorless basic dye (see Table 1) | 2.0 parts |
| 10% aqueous solution of polyvinyl alcohol | 4.6 parts |
| Water | 2.6 parts |
| Liquid B (dispersion of color-developing agent) | |
| 4,4'-isopropylidenediphenol | 6.0 parts |
| 10% aqueous solution of polyvinyl alcohol | 18.8 parts |
| Water | 11.2 parts |
| Liquid C (dispersion of stabilizer) | |
| Stabilizer (see Table 1) | 4.0 parts |
| 10% aqueous solution of polyvinyul alcohol | 9.2 parts |
| Water | 5.2 parts |

Each liquid of the above-mentioned composition was ground to an average particle size of 1 micron by an attritor. Then, the dispersions were mixed in the following portion to prepare a coating color.

Coating Color

| | |
|---|---|
| Liquid A | 9.2 parts |
| Liquid B | 36.0 parts |
| Liquid C | 18.4 parts |
| Kaolin clay (50% aqueous dispersion) | 12.0 parts |

The coating color was applied on one side of a base paper weighing 50 g/m$^2$ at a coating weight of 6.0 g/m$^2$ and thend dried. The resultant paper was treated to a smoothness of 200–600 seconds by a supercalender. In this manner, a heat-sensitive recording sheet was obtained.

[Example 2 (Test Nos. 3–6)]

Liquid A (Dye dispersion 1)

-continued

| | |
|---|---|
| Colorless basic dye (see Table 1) | 1.0 part |
| 10% aqueous solution of polyvinyl alcohol | 2.3 parts |
| Water | 1.3 parts |
| Liquid D (Dye dispersion 2) | |
| Colorless basic dye (see Table 1) | 1.0 part |
| 10% aqueous solution of polyvinyl alcohol | 2.3 parts |
| Water | 1.3 parts |

Each liquid of the above-mentioned composition was ground to an average particle size of 1 micron by an attritor. Then, the dispersions were mixed in the following portion to prepare a coating color.

Coating Color

| | |
|---|---|
| Liquid A (dye dispersion 1) | 4.6 parts |
| Liquid D (dye dispersion 2) | 4.6 parts |
| Liquid C (dispersion of stabilizer) | 18.4 parts |
| Liquid B (dispersion of color-developing agent) | 36.0 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner, a heat-sensitive recording sheet was obtained.

[Comparative Example 1 (Test Nos. 7–9)]

A heat-sensitive recording sheet was obtained in the same manner as in Example 1 except that Liquid C is not used. With regard to the heat-sensitive recording sheets of Examples No. 1 and No. 2 and Comparative Example 1, the test results are shown in Tables 1 and 2.

TABLE 1

Test Results

| | Test No. | Stabilizer | Colorless basic dye 1 | Colorless basic dye 2 | Image density Static (1) | Image density Dynamic(2) |
|---|---|---|---|---|---|---|
| Example 1 | 1 | p-chlorobenzoic acid zinc salt | 2-chloro-3-methyl-6-p-(p-phenylaminophenyl)amino-anilinofluorane | — | 1.38 | 0.74 |
| | 2 | m-chlorobenzoic acid zinc salt | 2-methyl-6-p-(p-dimethylaminophenyl)aminoanilinofluorane | — | 1.37 | 0.75 |
| Example 2 | 3 | p-chlorobenzoic acid zinc salt | 2-chloro-3-methyl-6-p-(p-phenylaminophenyl)amino-anilinofluorane | 3,6-bis(dimethyl-amino)fluorene-9-spiro-3'-(6'-dimethylamino)phthalide | 1.30 | 0.72 |
| | 4 | m-chlorobenzoic acid zinc salt | 2-methyl-6-p-(p-dimethylaminophenyl)aminoanilinofluorane | 3,6-bis(dimethyl-amino)fluorene-9-spiro-3'-(6'-dimethylamino)phthalide | 1.31 | 0.73 |
| | 5 | 3,4-dichlorobenzoic acid zinc salt | 2-chloro-3-methyl-6-p-(p-phenylaminophenyl)amino-anilinofluorane | 3,3-bis[1,1-bis(4-pyrrolidino-phenyl)ethylene-2-yl]-4,5,6,7-tetrachlorophthalide | 1.29 | 0.71 |
| | 6 | 3,4-dichlorobenzoic acid zinc salt | 2-methyl-6-p-(p-dimethylaminophenyl)aminoanilinofluorane | 3,3-bis[1,1-bis(4-pyrrolidino-phenyl)ethylene-2-yl]-4,5,6,7-tetrachlorophthalide | 1.29 | 0.72 |
| Comparative Example 1 | 7 | — | 2-chloro-3-methyl-6-p-(p-phenylaminophenyl)amino-anilinofluorane | — | 1.25 | 0.74 |
| | 8 | — | 2-methyl-6-p-(p-dimethylaminophenyl)aminoanilinofluorane | — | 1.24 | 0.73 |
| | 9 | — | 3,6-bis(dimethyl-amino)fluorene-9-spiro-3'-(6'-dimethylamino)phthalide | — | 1.13 | 0.71 |

TABLE 2

| | Test No. | Infrared reflectance (%) (3) | Test Results: Light resistance (4) Before treatment | After treatment | Percent residue (%) | Infrared reflectance (%) | Oil resistance (5) Before treatment | After treatment | Percent residue (%) | Infrared reflectance (%) | Weather resistance (6) Before treatment | After treatment | Percent residue (%) | Infrared reflectance (%) |
|---|---|---|---|---|---|---|---|---|---|---|---|---|---|---|
| Example 1 | 1 | 25 | 0.74 | 0.74 | 100 | 25 | 0.74 | 0.72 | 97 | 28 | 0.74 | 0.73 | 99 | 26 |
| | 2 | 26 | 0.75 | 0.7 | 100 | 26 | 0.75 | 0.74 | 99 | 27 | 0.75 | 0.73 | 97 | 27 |
| Example 2 | 3 | 22 | 0.72 | 0.72 | 100 | 22 | 0.72 | 0.70 | 98 | 24 | 0.72 | 0.71 | 99 | 23 |
| | 4 | 22 | 0.73 | 0.73 | 100 | 22 | 0.73 | 0.71 | 97 | 24 | 0.73 | 0.71 | 97 | 24 |
| | 5 | 21 | 0.71 | 0.70 | 99 | 21 | 0.71 | 0.70 | 99 | 23 | 0.71 | 0.70 | 99 | 23 |
| | 6 | 21 | 0.72 | 0.71 | 99 | 21 | 0.72 | 0.71 | 99 | 23 | 0.72 | 0.70 | 98 | 23 |
| Comparative Example 1 | 7 | 35 | 0.74 | 0.65 | 88 | 49 | 0.74 | 0.36 | 49 | 75 | 0.74 | 0.58 | 78 | 57 |
| | 8 | 34 | 0.73 | 0.64 | 87 | 50 | 0.73 | 0.36 | 49 | 74 | 0.73 | 0.57 | 78 | 55 |
| | 9 | 35 | 0.71 | 0.30 | 42 | 80 | 0.71 | 0.10 | 14 | 99 | 0.71 | 0.40 | 56 | 73 |

Notes (1) Static image density

A heat-sensitive recording sheet is pressed down for 5 seconds under pressure of 10 kg/cm2 on a hot plate heated at 135° C., and the optical density is measured by a Macbeth densitometer (RD-914, using amber filter which is used in other samples).

(2) Dynamic image density

A heat-sensitive recording sheet is recorded with an impressed voltage of 18.03 Volt and a pulse width of 3.2 milli-seconds by using the thermal facsimile KB-4800 manufactured by TOSHIBA CORPORATION, and the optical density of the recorded image is measured by a Macbeth densitometer.

(3) Reflectance of infrared ray

The recorded image printed in Note (1) is measured by a spectrophotometer (using a wave length of 940 nm).

(4) Light resistance

The image density obtained in Note (2) is defined as image density before light treatment. The recorded image is subjected to irradiation by light for 2 hours using a fade-O-meter, and then the image density (after light treatment) is measured. Residual rate is calculated from the following equation.

$$\text{Residual rate} = \frac{\text{Image density after light treatment}}{\text{Image density before light treatment}} \times 100\ (\%)$$

And the reflectance of infrared red ray is measured with respect to the recorded image after light irradiation.

(5) Oil resistance

The image density obtained in Note (2) is defined as image density before oil treatment. A drop of castor oil is applied on the recorded image, and wished off with filter paper after 10 sec. The obtained paper allows to stand for 24 hours at room temperature, and image density after oil treatment is measured. Residual rate is calculated from the following equation.

$$\text{Residual rate} = \frac{\text{Image density after oil treatment}}{\text{Image density before oil treatment}} \times 100\ (\%)$$

And the reflectance of infrared ray is measured with respect to the recorded image after oil treatment.

(6) Weather resistance

The image density obtained in Note (2) is defined as image density before treatment. The recorded image allows to stand for a week under the conditions of 40° C. and 90% RH, and then the image density is measured by Macbeth densitometer.

$$\text{Residual rate} = \frac{\text{Image density after treatment}}{\text{Image density before treatment}} \times 100\ (\%)$$

And the reflectance of infrared ray is measured by spectrophotometer (using a wave length of 940 nm) with respect to the recorded image after treatment.

[Example 3 (Test Nos. 10–15)]

| | |
|---|---|
| Liquid A (dye dispersion | |
| Colorless basis dye (see Table 3) | 2.0 parts |
| 10% aqueous solution of polyvinyl alcohol | 4.6 parts |
| Water | 2.6 parts |
| Liquid B (dispersion of color-developing agent) | |
| Color-developing agent (see Table 3) | 4.0 parts |
| 10% aqueous solution of polyvinyl alcohol | 18.8 parts |
| Water | 11.2 parts |
| Liquid C (dispersion of stabilizer) | |
| Stabilizer (see Table 3) | 4.0 parts |
| 10% aqueous solution of polyvinyl alcohol | 9.2 parts |
| Water | 5.2 parts |

Each liquid of the above-mentioned composition was ground to an average particle size of 1 micron by an attritor. Then dispersions were mixed in the following portion to prepare a coating color.

Coating Color

| | |
|---|---|
| Liquid A (dye dispersion) | 9.2 parts |
| Liquid B (dispersion of color-developing agent) | 36.0 parts |
| Liquid C (dispersion of stabilizer) | 18.4 parts |
| Kaolin clay (50% aqueous solution) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner, a heat-sensitive recording sheet was obtained.

[Comparative Example 2 (Test Nos. 16–18)]

A heat-sensitive recording sheet was obtained in the same manner as in Example 3 except that Liquid C is not used. With regard to the heat-sensitive recording sheets of Example No. 3 and Comparative Example 2, the test results are shown in Tables 3 and 4.

TABLE 3

| | Test No. | Color-developing agent | Stabilizer | Colorless basic dye | Image density: Static (1) | Dynamic (2) |
|---|---|---|---|---|---|---|
| Example 3 | 10 | 4,4'-isopropylidenediphenol | p-chlorobenzoic acid zinc salt | 3,3-bis[2-(p-dimethylaminophenyl)-2-(p-methoxyphenyl)ethenyl]-4,5,6,7-tetrabromophthalide | 1.50 | 1.19 |
| | 11 | 4,4'- | m-chlorobenzoic | 3,3-bis[2-(p-dimethylaminophenyl)-2-(p- | 1.49 | 1.18 |

TABLE 3-continued

| | Test No. | Color-developing agent | Stabilizer | Colorless basic dye | Image density Static (1) | Image density Dynamic (2) |
|---|---|---|---|---|---|---|
| | | isopropylidenediphenol | acid zinc salt | methoxyphenyl)ethenyl]-4,5,6,7-tetrabromophthalide | | |
| | 12 | 1,7-di(4-hydroxyphenylthio)-3,5-dioxaheptane | p-chlorobenzoic acid zinc salt | 3,3-bis[2-(p-dimethylaminophenyl)-2-(p-methoxyphenyl)ethenyl]-4,5,6,7-tetrabromophthalide | 1.51 | 1.19 |
| | 13 | 1,8-di(4-hydroxyphenylthio)-3,6-dioxaoctane | m-chlorobenzoic acid zinc salt | 3,3-bis[2-(p-dimethylaminophenyl)-2-(p-methoxyphenyl)ethenyl]-4,5,6,7-tetrabromophthalide | 1.50 | 1.18 |
| | 14 | 4-hyrdoxy-4'-isopropoxydiphenylsulfone | 3,4-dichlorobenzoic acid zinc salt | 3,3-bis[2-(p-dimethylaminophenyl)-2-(m,p-dimethoxyphenyl)ethenyl]-4,5,6,7-tetrabromophthalide | 1.48 | 1.19 |
| | 15 | 4-hydroxy-4'-isopropoxydiphenylsulfone | 3,4-dichlorobenzoic acid zinc salt | 3,3-bis[2-(p-dimethylaminophenyl)-2-(m,p-dimethoxyphenyl)ethenyl]-4,5,6,7-tetrabromophthalide | 1.50 | 1.18 |
| Comparative Example 2 | 16 | 4,4'-isopropylidenediphenol | — | 3,3-bis[2-(p-dimethylaminophenyl)-2-p-methoxyphenyl)ethenyl]-4,5,6,7-tetrabromophthalide | 1.11 | 1.03 |
| | 17 | 1,7-di(4-hydroxyphenylthio)-3,5-dioxaheptane | — | 3,3-bis[2-(p-dimethylaminophenyl)-2-p-methoxyphenyl)ethenyl]-4,5,6,7-tetrabromophthalide | 1.10 | 1.01 |
| | 18 | 4-hydroxy-4'-isopropoxydiphenylsulfone | — | 3,3-bis[2-(p-dimethylaminophenyl)-2-p-methoxyphenyl)ethenyl]-4,5,6,7-tetrabromophthalide | 1.11 | 1.00 |

TABLE 4

| | Test No. | Infrared reflectance (%) (3) | Light resistance (4) Before treatment | Light resistance (4) After treatment | Light resistance (4) Percent residue (%) | Light resistance (4) Infrared reflectance (%) | Oil resistance (5) Before treatment | Oil resistance (5) After treatment | Oil resistance (5) Percent residue (%) | Oil resistance (5) Infrared reflectance (%) | Weather resistance (6) Before treatment | Weather resistance (6) After treatment | Weather resistance (6) Percent residue (%) | Weather resistance (6) Infrared reflectance (%) |
|---|---|---|---|---|---|---|---|---|---|---|---|---|---|---|
| Example 3 | 10 | 11 | 1.19 | 1.09 | 92 | 25 | 1.19 | 1.15 | 97 | 13 | 1.19 | 1.03 | 87 | 28 |
| | 11 | 11 | 1.18 | 1.07 | 91 | 24 | 1.18 | 1.16 | 98 | 14 | 1.18 | 1.00 | 85 | 27 |
| | 12 | 12 | 1.19 | 1.09 | 92 | 27 | 1.19 | 1.16 | 97 | 15 | 1.19 | 1.02 | 86 | 29 |
| | 13 | 11 | 1.18 | 1.08 | 92 | 25 | 1.18 | 1.14 | 97 | 14 | 1.18 | 1.02 | 86 | 27 |
| | 14 | 12 | 1.19 | 1.08 | 91 | 26 | 1.19 | 1.17 | 98 | 15 | 1.19 | 1.02 | 86 | 28 |
| | 15 | 11 | 1.18 | 1.06 | 90 | 25 | 1.18 | 1.16 | 98 | 15 | 1.18 | 1.00 | 85 | 27 |
| Comparative Example 2 | 16 | 17 | 1.03 | 0.62 | 60 | 70 | 1.03 | 0.50 | 49 | 80 | 1.03 | 0.41 | 40 | 90 |
| | 17 | 18 | 1.01 | 0.61 | 60 | 72 | 1.01 | 0.49 | 49 | 82 | 1.01 | 0.39 | 39 | 91 |
| | 18 | 20 | 1.00 | 0.60 | 60 | 71 | 1.00 | 0.48 | 48 | 85 | 1.00 | 0.38 | 38 | 92 |

Notes (1), (2) and (5) are measured in the same manner as in Notes (1), (2) and (5) of Tables 1 and 2.
(3) Reflectance of infrared ray
The recorded image printed in Note (2) is measured by a spectrophotometer (using a wave length of 1000 nm).
(4) Light resistance
The light resistance is measured in the same manner as in that of Tables 1 and 2 except using an irradiation by light for 4 hours.
(6) Weather resistance
The weather resistance is measured in the same manner as in that of Tables 1 and 2 except that the recorded image allows to stand for 24 hours and that a wave length used in spectrophotometer is 1000 nm.

We claim:

1. A heat-sensitive recording material comprising a support having thereon a color-developing layer which contains as main ingredient a colorless or pale colored basic chromogenic dye and an organic colordeveloping agent, wherein the color-developing layer comprises as the colorless or pale colored basic chromogenic dye at least one substance selected from the group consisting of a fluorane-type leuco dye represented by the following general formula (I) and a divinyl compound represented by the following general formula (II), and as a stabilizer at least one halogen-substituted zinc benzoate derivative represented by the following general formula (III):

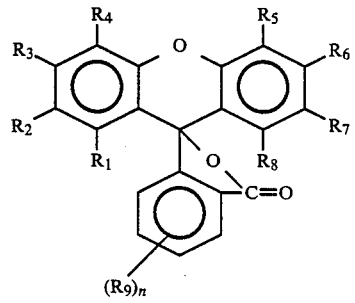

(I)

wherein at least one of $R_1$, $R_2$, $R_3$, $R_4$, $R_5$, $R_6$, $R_7$, $R_8$ and $R_9$ represents

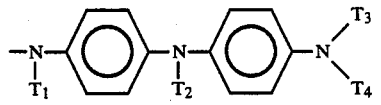

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group, or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with the nitrogen to which they are attached, may represent, a morpholino group, a pyrrolidino group, a piperidino group or a hexamethyleneimino group; and n represents an integer from 0 to 4;

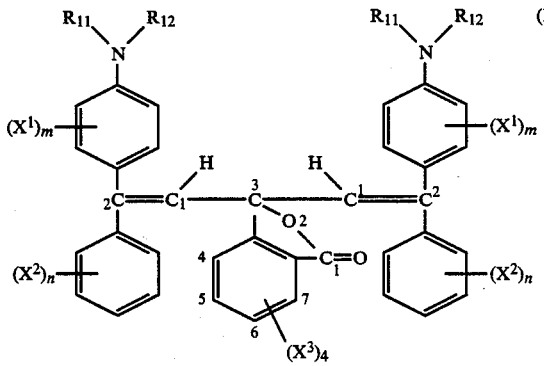

(II)

wherein $R_{11}$ represents an alkyl group of not more than 6 carbon atoms;

$R_{12}$ represents an alkyl group of not more than 8 carbon atoms, a $C_5$–$C_7$ cycloalkyl group, a benzyl group which may be substituted with a chlorine atom, a bromine atom and/or an alkyl group of not more than 4 carbon atoms, or a phenyl group which may be substituted with a chlorine atom, a bromine atom and/or an alkyl group of not more than 4 carbon atoms;

$X^1$ and $X^2$, which may be the same or different, represent an alkyl group of not more than 8 carbon atoms, an alkoxy group of not more than 8 carbon atoms, a fluorine atom, a chlorine atom or a bromine atom;

m and n each represents 0, 1, 2 or 3; each $X^1$ of $(X^1)n$, each $X^2$ of $(X^2)n$ or each $X^3$ of $(X^3)n$ can be the same or different;

and X3 represents a chlorine atom or a bromine atom, in which at least one of $X^3$ in $(X^3)_4$ represents a bromine atom;

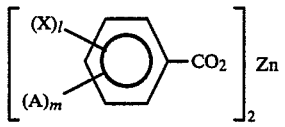

(III)

wherein

X represents a halogen atom;

A represents a halogen atom, a nitro group, a $C_1$–$C_{12}$ alkyl group, a $C_1$–$C_{12}$ alkoxy group, a $C_3$–$C_{10}$ cycloalkyl group, a cyano group or a hydroxy group; l represents 1 or 2; and m represents an integer from 0 to 5.

2. The heat-sensitive recording material according to claim 1, wherein the fluorane-type leuco dye represented by the general formula (I) is at least one dye selected from the group consisting of 2-chloro-3-methyl-6-p-(p-phenylaminophenyl)aminoanilinofluorane and 2-methyl-6-p-(p-dimethylaminophenyl)aminoanilinofluorane.

3. The heat-sensitive recording material according to claim 1, wherein the divinyl compound represented by the general formula (II) is 3,3-bis-4,5,6,7-tetrabromophthalide.

4. The heat-sensitive recording material according to claim 1, wherein the color-developing layer further comprises at least one sulfonyl methane derivative selected from the group consisting of bis(p-dimethylaminostyryl)-p-methylphenylsulfonylmethane, bis(p-diethylaminostyryl)-p-methylphenylmethane and bis(p-dimethylaminostyryl)-benzenesulfonylmethane.

5. The heat-sensitive recording material according to claim 1, wherein the color-developing layer further comprises at least one fluorene leuco dye selected from the group consisting of 3,6-bis(dimethylamino)fluorene-9-spiro-3'-(6'-dimethylamino)phthalide, and 3,6-bis(diethylamino)fluorene-9-spiro-3'-(6'-diethylamino)phthalide.

6. The heat-sensitive recording material according to claim 1, wherein the organic color-developing agent is at least one substance selected from the group consisting of bisphenols A, 4-hydroxybenzoic acid esters, 4-hydroxyphthalic acid diesters, phthalic acid monoesters, bis-(hydroxyphenyl)sulfides, 4-hydroxyphenl arylsulfonate, 4-hydroxyphenyl arylsulfonates, 1,3-dibenzenes, 4-hydroxybenzoyl oxybenzoic acid esters and bisphenol sulfonates.

7. The heat-sensitive recording material according to claim 1, wherein the color-developing layer comprises 1–8 parts by weight of the organic color-developing agent, 0.1–5 parts by weight of the stabilizer and 1–20 parts by weight of filler, based on 1 part by weight of the colorless basic chromogenic dye, and 10–25 parts by weight of binder in total solid content.

8. The heat-sensitive recording material according to claim 1, wherein the support is a film.

9. The heat-sensitive recording material according to claim 8, wherein said film is comprised of paper.

* * * * *